United States Patent [19]

Wolf et al.

[11] Patent Number: 4,897,160

[45] Date of Patent: Jan. 30, 1990

[54] HEAD BOX FOR A PAPER MAKING MACHINE

[75] Inventors: Karl Wolf; Dieter Egelhof, both of Heidenheim-Schnaitheim, Fed. Rep. of Germany

[73] Assignee: J. M. Voith GmbH, Fed. Rep. of Germany

[21] Appl. No.: 305,557

[22] Filed: Feb. 2, 1989

Related U.S. Application Data

[63] Continuation of Ser. No. 231,141, Aug. 10, 1988, which is a continuation of Ser. No. 148,059, Jan. 25, 1988, abandoned, which is a continuation of Ser. No. 24,852, Mar. 16, 1987, abandoned, which is a continuation of Ser. No. 434,262, Oct. 14, 1982, abandoned.

[30] Foreign Application Priority Data

Nov. 6, 1981 [DE] Fed. Rep. of Germany ..... 3144066

[51] Int. Cl.[4] ..... D21F 1/06

[52] U.S. Cl. ..... 162/343; 162/336; 162/339; 162/340

[58] Field of Search ..... 162/336, 339, 340, 343

[56] References Cited

U.S. PATENT DOCUMENTS

| | | | |
|---|---|---|---|
| 3,098,787 | 7/1963 | Sieber | 162/343 |
| 3,385,754 | 5/1968 | Burgess | 162/336 |
| 3,400,044 | 9/1968 | Justus | 162/343 |
| 3,598,696 | 8/1971 | Beck | 162/298 |
| 3,945,882 | 3/1976 | Egelhof et al. | 162/340 |
| 4,104,116 | 8/1978 | Koskimies | 162/343 |
| 4,146,427 | 3/1979 | Hogel et al. | 162/343 |

FOREIGN PATENT DOCUMENTS

| | | | |
|---|---|---|---|
| 1541109 | 10/1968 | France | 162/336 |
| 2093879A | 8/1982 | United Kingdom . | |

OTHER PUBLICATIONS

"The W-Type High-Turbulence Headbox", by Karl Wolf and Dieter Egelhof, Voith publication, Oct. 1981.

*Primary Examiner*—Peter Chin

*Attorney, Agent, or Firm*—Ostrolenk, Faber, Gerb & Soffen

[57] ABSTRACT

The head box for a paper making machine joins the main distribution channel with an outlet nozzle that extends over the width of the machine. The head box has a plurality of linear, tubular flow channels extending from the distribution channel to the outlet nozzle. Just before entry into the outlet nozzle, each channel widens continuously, forming a continuous diffuser communicating into the outlet nozzle. In each tubular flow channel, a respective channel piece of reduced inside diameter is provided at or just upstream of the continuous diffuser. The entrance into the channel piece is developed as a step-like reduction in cross-section of the tubular channel, as compared with the cross-section of the tubular channel just upstream. The channel piece with the reduced cross-section may be defined at the entrance end of one part of the channel that is installed into a wider diameter second part of the channel that is immediately upstream, may be located at or just upstream of the continuous diffuser at the end of the tubular flow channel, or may be a bushing inserted into the tubular flow channel upstream of the continuous diffuser at the end thereof. Furthermore, a plurality of channel pieces, each with a reduced cross-section entrance, may be inserted in series in the main tubular channel.

16 Claims, 1 Drawing Sheet

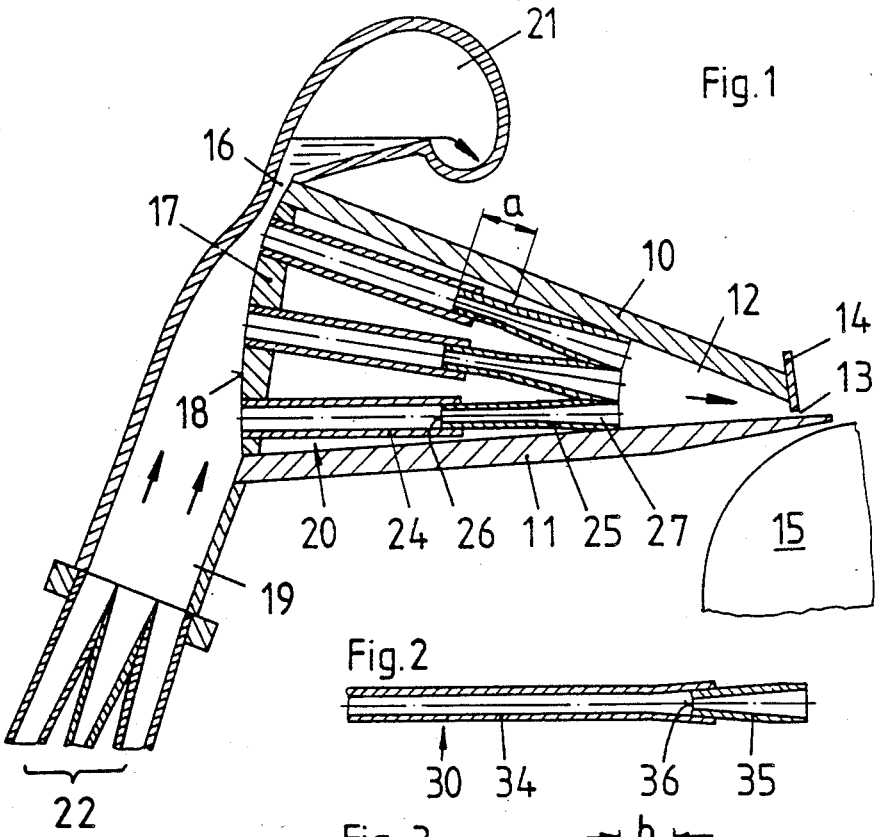
Fig.1
Fig.2
Fig.3
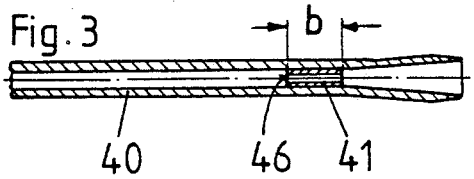
Fig.4
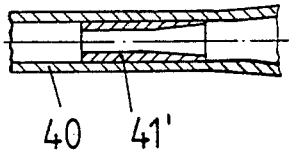
Fig.5
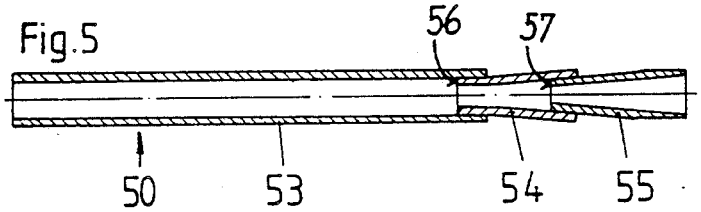

HEAD BOX FOR A PAPER MAKING MACHINE

This is a continuation of application Ser. No. 231,141, filed Aug. 10, 1988, which is a continuation of application Ser. No. 148,059, filed Jan. 25, 1988 abandoned, which is a continuation of application Ser. No. 024,852, filed Mar. 16, 1987 abandoned, which is a continuation of application Ser. No. 434,262, filed Oct. 14, 1982 abandoned.

BACKGROUND OF THE INVENTION

The present invention relates to a head box for a paper making machine, cardboard making machine, or the like, having a plurality of flow channels and particularly to means for improving turbulence in the pulp.

For decades, efforts have been made to improve the head boxes so that the jet of pulp emerging from the head box has a uniform velocity distribution and so that the finest possible uniform distribution of the fibers within the stream of pulp is assured.

Until now, this purpose has been substantially achieved with various measures. The constructions described in the following publications have been particularly satisfactory: Federal Republic of Germany AS 2 007 308 (which is similar to U.S. Pat. No. 3,769,155), and Federal Republic of Germany AS 2 308 849 (which corresponds to U.S. Pat. No. 3,945,822). In accordance with these constructions, the fiber suspension of pulp in the head box is conducted through a plurality of channels, which are distributed over the width of the machine. These channels are relatively long and of small inside diameter. In this way, so-called microturbulence is produced by wall friction of the pulp in each of the channels. The intensity of the turbulence is generally so great that any fiber flocculations formed are again broken down or are kept so small that, as a rule, they are not detrimental to the finished paper. At the same time, the channels gradually widen continuously before discharging into the outlet nozzle. As a result, the entire flow cross-section available increases only slightly, if at all, at the point of discharge from the channels into the outlet nozzle, so that the so-called entrance surge is kept small and the occurrence of eddies in the outlet nozzle is avoided. (If the channels converge toward each other in the direction of flow, as seen in side view, then it may be that the channels, as seen in this side view, do not widen continuously. In all cases, however, there is a continuous widening of the channels when the plurality of channels is seen in top view.)

One prerequisite for the good action of these known constructions is that a relatively high flow velocity be provided in the channels and in the outlet nozzle. These known head boxes are therefore particularly suitable for a high speed paper making machine. However, difficulties occur when such a head box is to be used on a machine of relatively low operating speed. In that case, the number of channels (seen in side view) and the inside diameter of each of these channels can be reduced only within narrow limits. There is still the possibility of feeding the fiber suspension in more highly diluted form to the head box. However, this requires a higher expenditure of energy for circulating the pulp water, which requires disagreeably large pumps and pipelines.

SUMMARY OF THE INVENTION

The object of the present invention is, therefore, to provide a head box of the type described above which can be operated at the lowest possible expense not only at high operating speads but also at relatively low operating speeds without greater dilution of the pulp being necessary. At the same time, the fiber distribution in the emerging stream of pulp should be at least as good as was previously achieved, or preferably even better.

This object is achieved by a head box having a plurality of tubular flow channels for joining the feed channel for the fiber pulp suspension to the outlet nozzle of the head box. In accordance therewith, a step-like constriction or reduced diameter cross-section is provided in each of the plurality of channels of the head box shortly before its discharge into the outlet nozzle. This assures uniform pulp velocity distribution and encourages microturbulence of the pulp. One essential feature is that each step-like constriction is part of a short length channel member of reduced inside diameter. Therefore, over a short distance, the reduced inside diameter is retaind downstream of the step-like constriction. Alternativey, downstream of the step-like constriction, there follows, either directly or slightly spaced therefrom, a slight, continuous, diffuserlike widening. But, the step-like constriction must not be immediately followed by a step-like widening. If the channel member, which is provided with the step-like constriction at its inlet, has at least a given minimum length, then, if necessary, such a step-like widening may be arranged on its end. The invention is based on the discovery that a boundary layer, which has a low number of long fibers, is formed in each of the channels in case of relatively low velocity of pulp flow and stable, uniform velocity distribution. As a result of the sudden increase in the velocity of flow at the step-like point of entrance into the narrow channel length, the previously produced boundary layer, which is poor in long fibers, is avoided. The desired stable, uniform velocity of flow is then reestablished within a certain, usually relatively short, distance following or downstream of the step-like constriction. When a step-like widening is arranged directly after the constriction, as would be the case, for instance, if a diaphragm were used, the above described effect cannot be obtained, since in such case an unstable flow is produced, presumably by production of eddies. With the avoidance of a sudden widening directly following the constriction, a toroidal eddy is produced there, as is known. It has been shown that it is very stable and extends in the direction of flow over only a relatively short path.

It is important that the constricted channel member not be too long, particularly when it is of constant inside diameter. Otherwise, there is the danger of a new formation of a boundary layer which is poor in long fibers. Therefore, discharge into the outlet nozzle must take place immediately following the constricted channel member so that the stream of pulp passes into the outlet nozzle in a thoroughly mixed and stable condition.

If necessary, upstream of and at a certain distance from the step-like constriction, as seen in the directon of flow, another step-like constriction, with a corresponding channel member of reduced inside diameter, can be provided. In general, however, a single step-like constriction is sufficient.

Furthermore, it is important that a reduction in the cross-section, and not a widening, takes place at the step. Apparently, after a step-like widening, microturbulences are produced only within a boundary layer having a thickness which corresponds approximately to the height of the step. In contrast thereto the toroidal eddy produced with the invention acts onto the center of the cross section of the channel.

Both in known head boxes and in the head box of the invention, for the reasons indicated above, each of the channels has a slight diffuser-like widening upstream of the point of discharge into the outlet nozzle. This may be a continuous or a known step-shaped widening or else may be a partly step-shaped and partly continuous widening. When the channel member of reduced inside diameter according to the invention is arranged directly upstream of, or is slightly spaced upstream of the difuser-like widening, then a cross-section which is constant over its entire length is preferably provided in the channel member.

In another embodiment of the invention, the step-like constriction is provided within, rather than in front of, the continuous diffuser-like widening at the outlet of the channels. Thus, the continuous diffuser-like widening commences even in front of the step and continues beyond the step.

Initially, there were serious doubts about the invention. It was feared that constrictions of the channels, and particularly step-like constrictions, could form points for the deposit of fibers. In the extreme case, clogging was feared. Actually, the very extensive literature on head boxes shows that based upon findings made up to the present, one practically always avoided providing an additional step-like constriction in the pulp feed channels, which were mostly very narrow to begin with. One of the few exceptions appears to be FIG. 7 of Federal Republic of Germany AS 2 007 308. In that case, channels consisting of two sections 17*a* and 17*b* are drilled in solid parts 41, 42 of a head box. At each transition point between two sections 17*a* and 17*b*, the channels are widened in a step-like manner. A distributor pipe 15 dischrges into each of the first sections 17*a*. The drawing of that publication gives the impression that a step-like constriction is provided at the transition point between the distributor tube 15 and the channel section 17*a*. Actually, however, this is merely a simplified and somewhat inaccurate manner of drawing the actual structure, since the inside diameter of the distributor tubes 15 has been omitted in the drawing. Nor does the text of the German publication indicate that a step-like narrowing was intended. Even if this had been the case, the effect obtained by the invention could not be obtained with the arrangement shown there. The step-wise constriction would in that case be arranged at much too great a distance from the discharge of the channels into the outlet nozzle. As a result, edge layers, which are poor in long fibers, would again be formed in the intermediate long channel section 17*b*. The step-like constrictons would, therefore, not have any effect.

This is true also of another known head box' (shown in Federal Republic of Germany AS 27 26 709 which corresponds to U.S. Pat. No. 4,198,270. This has four transverse distributor tubes 18 to which four rows of feed tubes 17 are connected and, also four rows of channels 3 as continuations of the distributor tubes. The flow cross-sections of these channels 3 is substantially smaller than that of the feed tubes 17, whereby a step-like reduction in cross-section is provided at the transition point. However, the length of the channels 3 is more than ten times their inside diameter so that the desired effect also cannot be obtained with thisknown arrangement.

As mentioned above, one important advantage of the head box of the invention is that the previously predominant constructions, which are intended only for high speeds of operation, can now be used also over the range of medium to low speeds of operation. However, the invention can also be used in a different manner. It is now also possible to operate at relatively high operating speeds with much less dilution and thus higher pulp density than before. In this way, savings in structural volume and drive energy can be obtained in the water circuit which forms part of the head box.

Numerous attempts have also been made to develop head boxes for high pulp densities and high operating speeds. One example is known from Federal Republic of Germany OS 2 335 602, which corresponds to U.S. Pat. No. 3,954,558. In that case, the outlet nozzle of a head box is divided into a plurality of sections lying one after the other in the direction of flow. The sections form a zig-zag flow channel having the width of the machine. This manner of construction has the disadvantage that the pulp velocity distribution in the emerging jet of pulp is not sufficiently uniform. This apparatus has therefore not gained acceptance in practice. As compared with this, when the step-wise constrictions of the invention are used, no impairment in the velocity profile of the pulp within the outlet jet has been observed. Thus, the weight per unit of surface of the finished paper web, measured over its width, is still of great uniformity. In addition, it has surprisingly been found that with use of the invention, the small flakes which are generally unavoidable and generally also not disturbing in the finished web of paper could be substantially eliminated.

BRIEF DESCRIPTION OF THE DRAWINGS

Illustrative embodiment of the invention will be described below with reference to the accompany drawing, in which:

FIG. 1 diagrammatically shows a head box seen from one side in longitudinal section;

FIGS. 2 to 5 show individual channels of embodiments differing from FIG. 1.

DESCRIPTION OF THE PREFERRED EMBODIMENTS

The head box shown in FIG. 1 comprises upper and lower limiting walls 10 and 11, which converge toward each other to form an outlet nozzle 12 having an outlet slot 13 extending the width of the machine. The inside size of the slot 13 can be varied by means of a displaceable diaphragm 14. The emerging jet of pulp passes in customary manner onto a traveling wire screen (now shown) which passes over a head roll 15, only part of which is visible.

Between the limiting walls 10 and 11, there are a plurality of channels 20 comprised of a plurality of straight tubes, so-called turbulence tubes, which are distributed uniformly over the height of the head box and also over the width of the machine and which have a substantially uniform (constant) pulp flow cross-section. Only three vertically superimposed turbulence tubes 20 are visible in the drawing but the tubes are arrayed both vertically and horizontally across the machine. The tubes 20 are fastened at their inlet sides in a rigid entrance plate 17, which has a convexly curved inflow surface 18. The paper pulp liquid suspension is fed to the in-flow surface through a central channel 19, which is as wide as the machine. The direction of flow of the channel 19 is at an inclined angle with respect to the direction of flow through the outlet nozzle 12. In a known manner, an overflow slot 16 is present at the terminal end of the central channel 19 and the slot discharges from the bottom into a surge tank 21. The customary transverse distribution tube which extends transverse to the machine direction beneath the channel 19 has been omitted in the drawing. Part of the plurality of tubes connect 22, which the transverse distribution tube with the central channel 19 is shown. Alternatively, the transverse distribution tube could be arranged directly in the vicinity of the plate 17. This would avoid the need for the plurality of tubes 22 and for the central channel 19.

Each turbulence tube 20 is comprises of a cylindrical entrance piece 24 and an end piece 25 which is narrow enough to be inserted into the piece 24. By this insertion of entrance end piece 25, a step-wise reduction in cross-section is formed in the channel at 26. At this insertion point in the entrance piece 24, the cross-sectional area of the channel 26 is about 30% to 70% smaller than the cross-sectional area of the channel in the region of the entrance piece 24. The reduced cross-sectional area of the end piece 25 remains unchanged oer a short initial distance a. This is followed by a slight continuous widening of the flow cross-section which defines a diffuser 27. At the outlet ends of the turbulence tubes 20, the wall thickness of the vertically superimposed end pieces 25 is tapered narrower to form a sharp edge at the channel outlet. In this way, the turbulence tubes conerge with respect to each other up to just prior to discharge into the outlet nozzle 12.

In FIG. 1, the step-like reduction 26 in cross-section is located approximately in the center of the length of each turbulence tube 20. However, it is desirable to arrange this constriction in cross-section at the smallest possible distance from the outlet end of the tube and, therefore, as close as possible to the place of discharge of the channels into the outlet nozzle 12. This could be obtained in the case of FIG. 1, for instance, by lengthening the entrance piece 24 and shortening the length a of the end piece 25.

FIG. 2 shows one possibility for displacing the constriction 36 in cross-section as close as possible toward the outlet end of the tube 20. In the case of the turbulence tube 30, the continuous, diffuser-like widening begins even before the step-wise constriction in cross-section 36. As a result, the outlet end of entrance piece 34 is already somewhat conically widened before the end piece 35, and the end piece 35 is developed as a diffuser over its entire length to the outlet nozzle.

In the turbulence tube 40 shown in FIG. 3, the step-wise constriction in cross-section 46 of the tube 40 is defined by the end surface of an inserted bushing 41. Aside from this inserted bushing inside the turbulence tube 40, the tube is comprises of a single piece, as in the case of traditional head boxes. Thus, the construction shown in FIG. 3 is also suitable for retrofitting an existing head box. The bushing 41 has a constant flow cross-section over its entire length b. At the end of the bushing 41, there is a step-like widening in cross-section. However, this is without importance for obtaining the effects of the invention. This bushing is followed by the customary continuous widening in cross-section up to the outlet end of the turbulence tube 40. As already mentioned above, the length b of the bushing 41 should not be selected to be too small, due to the step-like widening in cross-section at its end. On the other hand, the bushing 41 should also not be made excessively long, because in that case, the distance between the step-like constriction in cross-section 46 and the outlet end becomes too great. Favorable results are obtained when the length b is equal to about 3 to 6 times the inside diameter of the bushing 41.

The bushing 41', in FIG. 4, can differ from the bushing of FIG. 3 and can have a slight diffuser-like widening. There is a step-like constriction at the inlet to the bushing, but the bushing has a gradual widening in cross-section toward the outlet end of the bushing so that the step-like widening there is substantially or completely avoided.

The turbulence tube 50 shown in FIG. 5 is formed of three tube sections 53, 54 and 55, with each succeeding section having its narrower entrance end inserted into the wider outlet end of the preceding section. In this case, two successive step-like constrictions in cross-section 56 and 57 are produced.

As is known from Federal Republic of Germany AS 2 039 293, the turbulence tubes 20, 30, 40, 50, moving in the direction toward the outlet end of the tube, can pass from circular into polygonal cross-sectional shape. In such case, it is entirely possible to arrange the step-like constriction in cross-section in the region of the transition into the polygonal shape, particularly in the case of the embodiments in accordance with FIG. 2 or 5.

Although the present invention has been described in connection with a plurality of preferred embodiments thereof, many variations and modifications will now become apparent to those skilled in the art. It is preferred, therefore, that the present invention be limited not by the specific disclosure herein, but only by the appended claims.

What is claimed is:

1. A head box for a paper making machine, comprising:

a feed channel for feeding fiber pulp suspension; the feed channel extending over the width of the paper making machine; an outlet nozzle for the fiber pulp suspension, and the nozzle also extending over the width of the machine and being spaced away from the feed channel;

a plurality of circular tubular flow channels, each tubular flow channel extending from the feed channel to a respective downstream end toward the outlet nozzle, the channels being distributed over the width of the machine and over the height of the head box;

each tubular channel having inside it, more toward the downstream end thereof, a circular tubular channel piece with a reduced inside diameter, as compared with the inside diameter of the tubular channel upstream of the channel piece which is in the tubular flow channel, the channel piece having an entrance at its upstream end which produces a step-like reduction in cross-section inside the tubular flow channel, and each tubular flow channel having, upstream of the location of the channel piece therein a substantially constant pulp flow cross-section.

2. The head box of claim 1, wherein after the channel piece and directly upstream of the outlet nozzle, each of the tubular channels widens for defining a diffuser for suspension directly before the discharge of the suspension into the outlet nozzle.

3. The head box of claim 2, wherein each tubular channel extends linearly from the feed channel to the outlet nozzle.

4. The head box of claim 2, wherein the step-like reduction is followed in the direction of flow by the diffuser, which is a continuous diffuser which widens in cross-section continuously following the step-like reduction in cross-section.

5. The head box of claim 4, wherein the continuous diffuser follows immediately after the step-like reduction in cross-section.

6. The head box of claim 2, wherein the step-like reduction in cross-section is located within the tubular flow channel within the region of the widening which serves as the continuous diffuser.

7. The head box of claim 2, wherein a distance downstream of the step-like reduction in cross-section, the tubular channel having a second step-like reduction cross-section defined in it.

8. The head box of claim 2, wherein the channel piece has a reduced inside diameter over its length, and the outlet from the channel piece comprising a step-like widening in cross-section.

9. The head of claim 8, wherein the inside diameter of the channel piece is constant over its length.

10. The head box of claim 9, wherein the length of the reduced diameter channel piece is 3–6 tims the size of its inside diameter.

11. The head box of claim 9, wherein the channel piece, and particularly the step-like widening at the outlet thereof is located directly upstream of the continuous widening of the tubular channel having the shape of a continuous diffuser.

12. The head box of claim 7, wherein each of the step-like reductions in cross-section is defined on a respective channel piece which is removably inserted ito a separable part of the channel piece immediately upstream of the respective channel piece and upstream of its reduction in cross-section.

13. The head box of claim 2, wherein the step-like reduction in cross-section is defined on a channel piece which is removably inserted into a separate piece of the tubular channel upstream of the channel piece and upstream of its reduction in cross-section.

14. The head box of claim 2, wherein the inside cross-sectional area of the channel piece is reduced at the step-like reduction in cross-section by 30%–70% as compared with the channel cross-section directly upstream of the reduction in cross-section.

15. The head box of claim 1, wherein the channel piece is a separate part from and installed in the tubular flow channel.

16. The head box of claim 15, wherein the channel piece is removably inserted in the tubular flow channel.

* * * * *